US010080437B1

(12) United States Patent
Tang

(10) Patent No.: US 10,080,437 B1
(45) Date of Patent: Sep. 25, 2018

(54) CONNECTOR FOR SHELF ASSEMBLY

(71) Applicant: Pao-Hsun Tang, Changhua (TW)

(72) Inventor: Pao-Hsun Tang, Changhua (TW)

(73) Assignee: Malzine Co. Ltd., Changhua (TW)

( * ) Notice: Subject to any disclaimer, the term of this patent is extended or adjusted under 35 U.S.C. 154(b) by 0 days.

(21) Appl. No.: 15/649,221

(22) Filed: Jul. 13, 2017

(51) Int. Cl.
*A47B 96/06* (2006.01)
*A47B 96/02* (2006.01)
*A47B 47/00* (2006.01)

(52) U.S. Cl.
CPC ..... *A47B 96/024* (2013.01); *A47B 47/0091* (2013.01); *A47B 96/063* (2013.01)

(58) Field of Classification Search
USPC ..... 248/220.1
See application file for complete search history.

(56) References Cited

U.S. PATENT DOCUMENTS 3,981,251 A * 9/1976 Damberg ..... A47B 57/18 108/154
4,318,352 A * 3/1982 Friedman ..... A47B 57/265 108/107
4,750,626 A * 6/1988 Nicely ..... A47B 57/265 108/192
6,015,052 A * 1/2000 Goldberg ..... A47B 57/545 108/106
6,044,988 A * 4/2000 Yang ..... A47B 57/265 108/107
6,068,143 A * 5/2000 Wang ..... A47B 57/265 108/144.11
6,695,156 B1 * 2/2004 Wang ..... A47B 57/265 108/147.11
7,059,484 B1 * 6/2006 Goldberg ..... A47B 47/0083 211/153
7,513,471 B2 * 4/2009 Moufflet ..... A47F 5/0892 248/218.4
7,543,540 B2 * 6/2009 Tatematsu ..... A47B 47/0083
7,568,436 B2 * 8/2009 McAllister ..... A47B 57/265 108/107
8,616,138 B1 * 12/2013 Fu ..... A47B 57/545 108/147.13
8,640,893 B2 * 2/2014 Kessell ..... A47B 57/26 211/187
8,678,207 B2 * 3/2014 Shimazaki ..... A47B 57/545 108/147.13

(Continued)

*Primary Examiner* — Monica E Millner
(74) *Attorney, Agent, or Firm* — Che-Yang Chen; Law Offices of Scott Warmuth

(57) ABSTRACT

A connector for shelf assembly may comprise at least a connector having a semi-cylindrical concave formed at a lateral edge thereof, and a first hook portion and a second hook portion respectively protrude from two lateral ends of the inner edge of the concave. When the connector is applied to a shelf, the first hook portion and the second hook portion thereof are configured to respectively hook on two adjacent edges of a shelf board of the shelf which are perpendicular to each other. Each of the connectors can be directly coupled with a collar of the shelf board such that an external board can be assembled between the two shelves without dissembling process. Also, the external board can be assembled parallel with the shelf boards on the two shelves, which improves the practicability and stability of the assembled shelves with the external board when in use.

2 Claims, 8 Drawing Sheets

(56) References Cited

U.S. PATENT DOCUMENTS

| | | | | |
|---|---|---|---|---|
| 8,887,647 | B2 * | 11/2014 | Sabounjian | A47B 57/10 108/147.13 |
| 9,314,098 | B2 * | 4/2016 | Sabounjian | A47B 96/024 |
| 9,468,294 | B2 * | 10/2016 | Fu | A47B 96/024 |
| 9,717,331 | B2 * | 8/2017 | Sabounjian | A47B 57/545 |
| 2010/0108631 | A1 * | 5/2010 | McAllister | A47B 57/545 211/187 |

* cited by examiner

CONNECTOR FOR SHELF ASSEMBLY

FIELD OF THE INVENTION

The present invention relates to a connector, and more particularly to a connector for shelf assembly.

BACKGROUND OF THE INVENTION

Referring to FIGS. 10 and 11, the conventional shelf (40) comprises at least four vertical poles (41), and a plurality of shelf boards (42) are respectively assembled therebetween. Each of the poles (41) has a plurality of locating washers coupled on an outer surface thereof, and each of four corners of the single shelf board (42) comprises a collar (421) which is configured to couple with the locating washer to secure the shelf board between the four vertical poles (41).

However, the conventional shelf is disadvantageous because: when two or more shelfs (40) need to be used in parallel, although the shelfs (40) can be bound together through straps, the structure of shelfs is not firm enough and easy to collapse. Another way to connect two shelfs (40) for use is to use additional shelf boards (42*a*) connected therebetween. Nevertheless, the method is also not desirable because the shelfs (40) have to be disassembled before assembling the additional shelf boards (42*a*) therebetween, which wastes time, and the additional shelf boards (42*a*) need to cooperate with the collars (421) to assemble on the poles (41), which makes the additional shelf boards (42*a*) unable to be assembled at a height level same as the shelf boards (42) of the shelf (40), thereby reducing the practicability. Therefore, there remains a need for a new and improved design for a connector for shelf assembly to overcome the problems presented above.

SUMMARY OF THE INVENTION

The present invention provides a connector for shelf assembly which comprises at least a connector. The connector has a semi-cylindrical concave formed at a lateral edge thereof, and an inner edge of the concave comprises a protruding portion. A first hook portion and a second hook portion respectively protrude from two lateral ends of the inner edge of the concave, and ends of the two hook portions are faced downwardly. The inner surface of the concave is formed into an attaching surface, and an arc-shaped first connecting member protrudes from the other lateral edge of the connector located opposite to the concave. Moreover, an engaging portion is integrally formed at an outer surface of the first connecting member. Furthermore, the connector has a hollow cushion member formed between the attaching surface and the first connecting member.

In one embodiment, an included angle between an axial central line of the concave to the first hook portion and the second hook portion is 90 degree such that when the connector is applied to a shelf, the first hook portion and the second hook portion thereof are configured to respectively hook on two adjacent edges of a shelf board of the shelf which are perpendicular to each other.

In another embodiment, an external board is assembled between the two shelves through the connectors, and each of the external boards comprises four concaved second connecting members respectively formed at four corners thereof and faced outwardly; a lower end of the second connecting member has two vertical engaging notches to form an engaging block therebetween, and the engaging block is configured to engage with the engaging portion of the first connecting member.

Comparing with conventional connector of shelf assembly, the present invention is advantageous because: (i) the connectors can be directly assembled on the collars of the shelf boards on the two shelves respectively, and the external board can be directly assembled between the two shelves without disassembling process; and (ii) the external board can be assembled parallel with the shelf boards on the two shelves, which improves the practicability and stability of the assembled shelves with the external board when in use.

DETAILED DESCRIPTION OF THE INVENTION

The detailed description set forth below is intended as a description of the presently exemplary device provided in accordance with aspects of the present invention and is not intended to represent the only forms in which the present invention may be prepared or utilized. It is to be understood, rather, that the same or equivalent functions and components may be accomplished by different embodiments that are also intended to be encompassed within the spirit and scope of the invention.

Unless defined otherwise, all technical and scientific terms used herein have the same meaning as commonly understood to one of ordinary skill in the art to which this invention belongs. Although any methods, devices and materials similar or equivalent to those described can be used in the practice or testing of the invention, the exemplary methods, devices and materials are now described.

All publications mentioned are incorporated by reference for the purpose of describing and disclosing, for example, the designs and methodologies that are described in the publications that might be used in connection with the presently described invention. The publications listed or discussed above, below and throughout the text are provided solely for their disclosure prior to the filing date of the present application. Nothing herein is to be construed as an admission that the inventors are not entitled to antedate such disclosure by virtue of prior invention.

Figure 1:
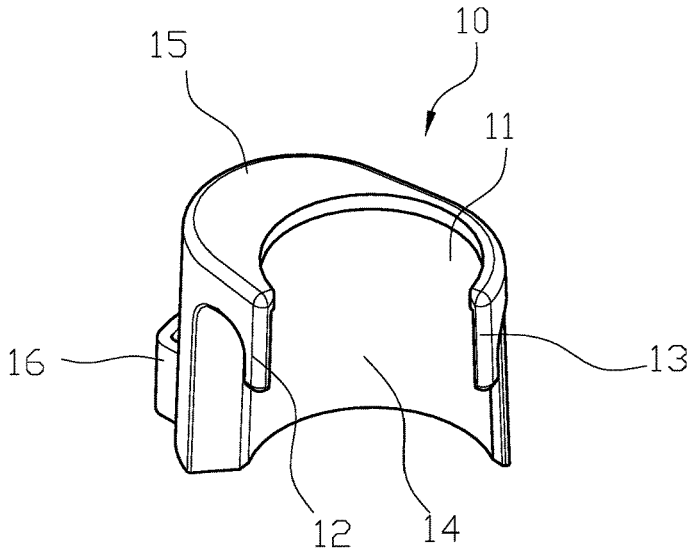
FIG. 1 is a three-dimensional assembly view of a connector for shelf assembly in the present invention.
Figure 2:
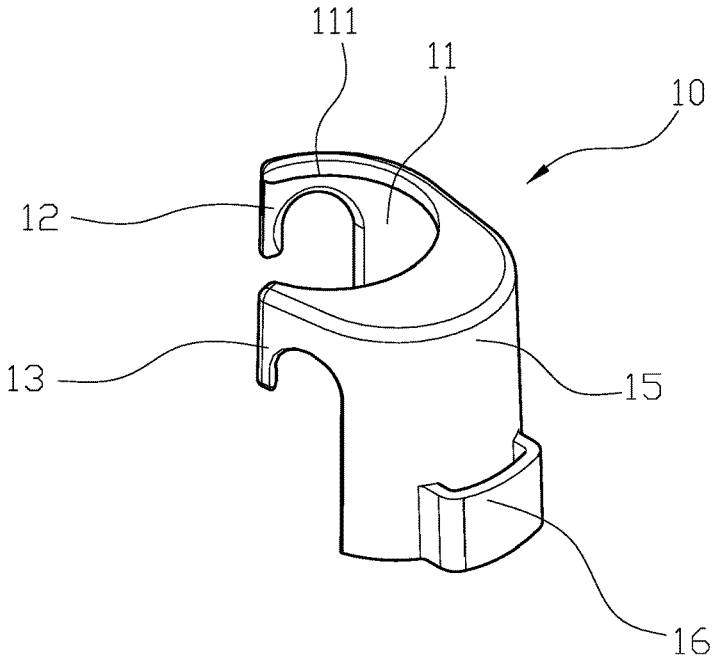
FIG. 2 is a three-dimensional assembly view from another angle of the connector for shelf assembly in the present invention.

In order to further understand the goal, characteristics and effect of the present invention, a number of embodiments along with the drawings are illustrated as following:

Referring to FIGS. 1 and 2, the present invention provides a connector for shelf assembly which comprises at least a connector (10). The connector (10) has a semi-cylindrical concave (11) formed at a lateral edge thereof, and an inner edge of the concave (11) comprises a protruding portion (111). A first hook portion (12) and a second hook portion (13) respectively protrude from two lateral ends of the inner edge of the concave (11), and ends of the two hook portions (12)(13) are faced downwardly. An included angle between an axial central line of the concave (11) to the first hook portion (12) and the second hook portion (13) is 90 degree such that when the connector (10) is applied to a shelf assembly, the first hook portion (12) and the second hook portion (13) thereof are configured to respectively hook on two adjacent edges of the shelf assembly which are perpendicular to each other. The inner surface of the concave (11) is formed into an attaching surface (14), and an arc-shaped first connecting member (15) protrudes from the other lateral edge of the connector (10) located opposite to the concave (11). Moreover, an engaging portion (16) is integrally formed at an outer surface of the first connecting member (15).

Figure 3:
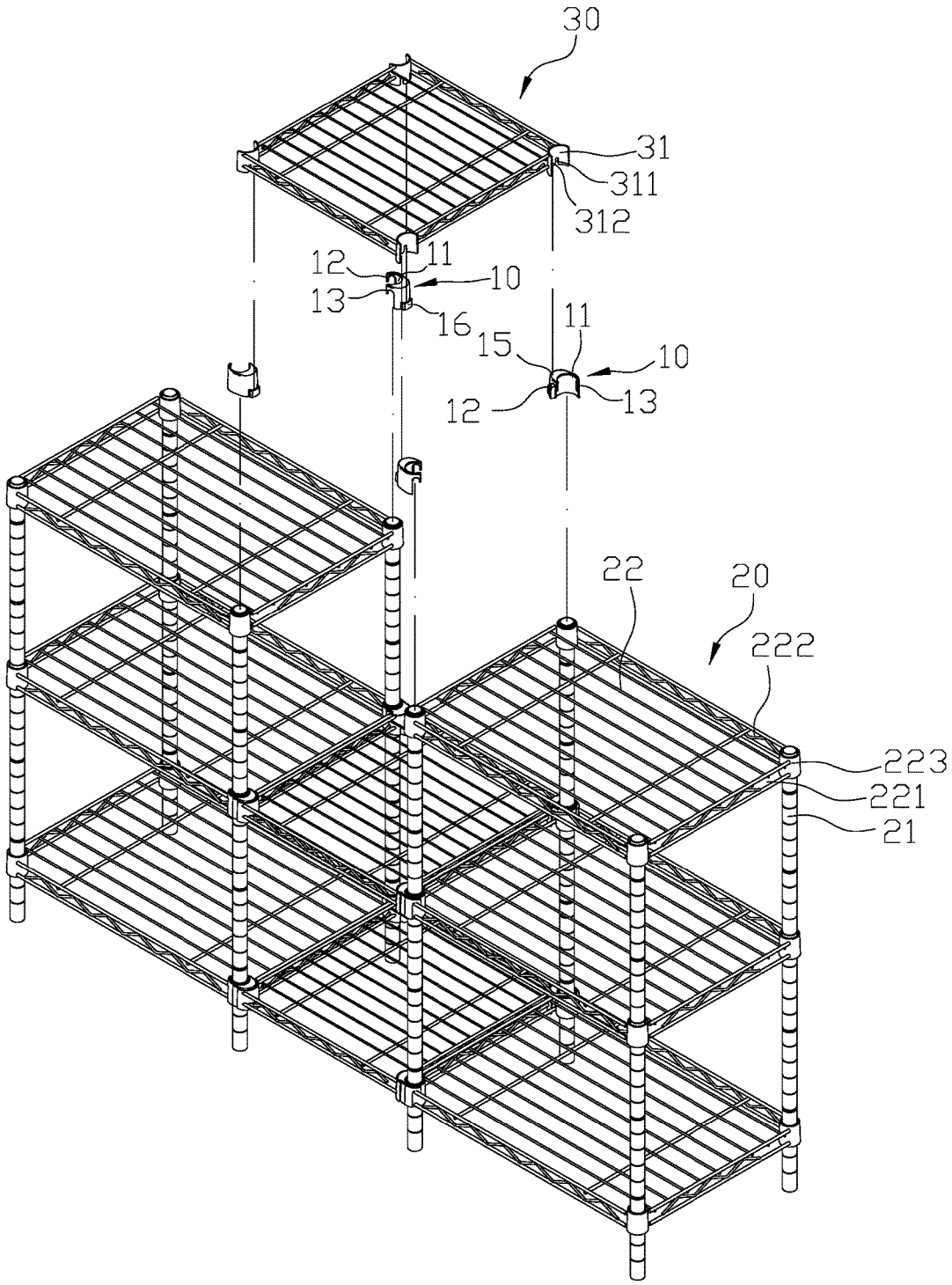
FIG. 3 is an exploded view illustrating that the connectors of the present invention are respectively assembled on two shelves.
Figure 4:
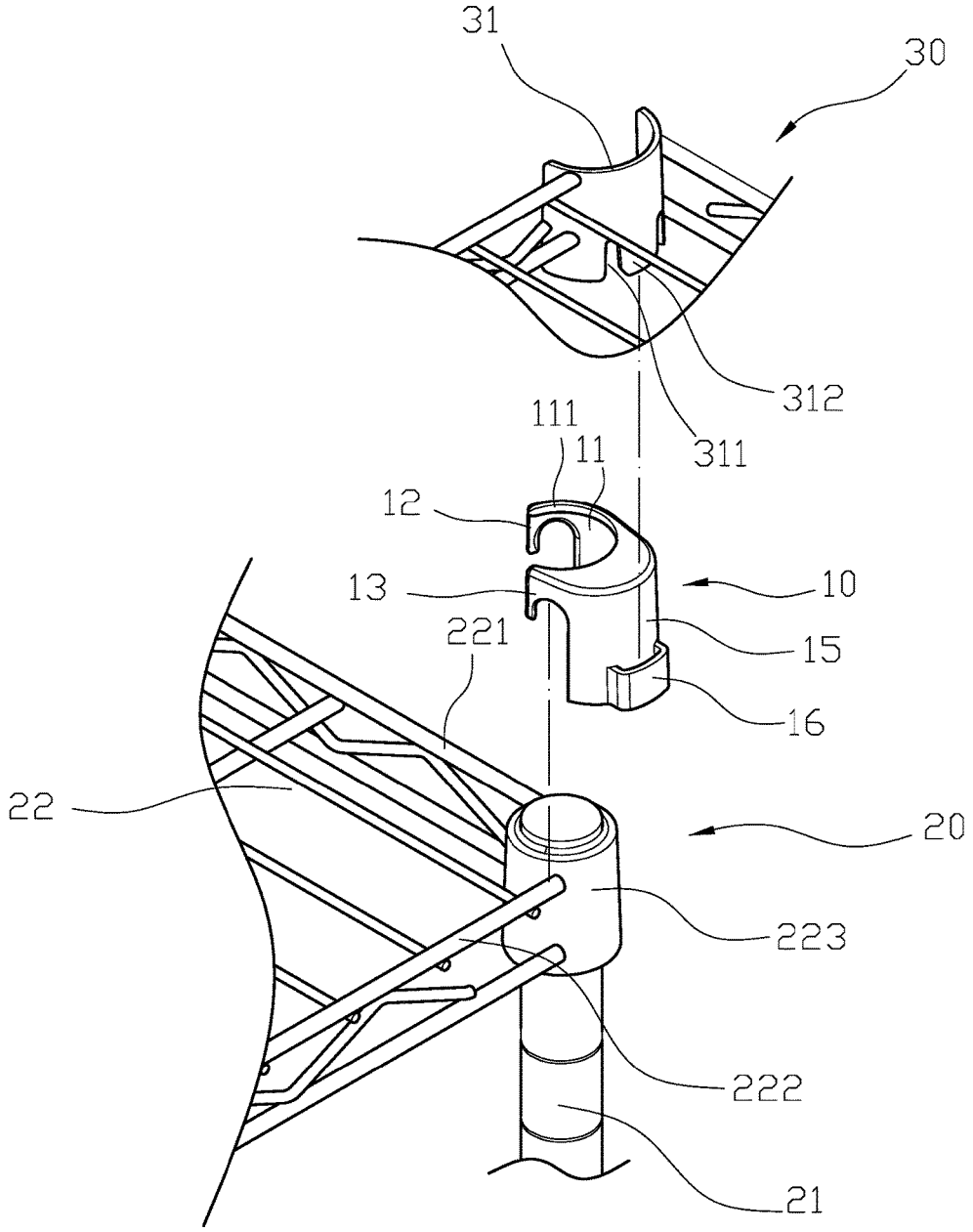
FIG. 4 is a partial enlarged exploded view illustrating the connector of the present invention is assembled on the shelf.

In actual application, referring to FIGS. 3 and 4, the four connectors (10) as two pairs are respectively assembled on two shelves (20) symmetrically, and at least an external board (30) is assembled between the two shelves (20) through the connectors (10), wherein each of the two shelves (20) comprises four vertical poles (21) and a plurality of shelf boards (22) assembled therebetween, and each of the poles (21) has a plurality of peripheral grooves sequentially formed at an outer surface thereof. Moreover, each of the shelf boards (22) is a square board having two pairs of parallel side bars, which are two first side bars (221) positioned along a front-back direction and two second side bars (222) positioned along a lateral direction, and each of four corners of the single shelf board (22) comprises a collar (223) to enable the shelf board (22) to be assembled between the four vertical poles (21).

Figure 5:
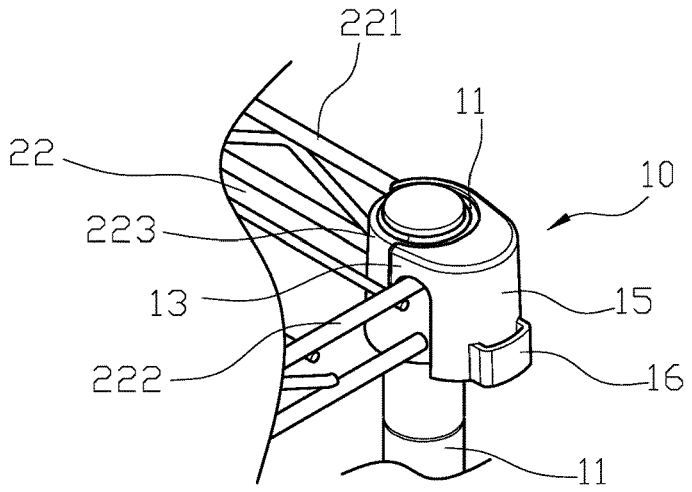
FIG. 5 is a schematic view illustrating the connector of the present invention is assembled on the shelf.
Figure 6:
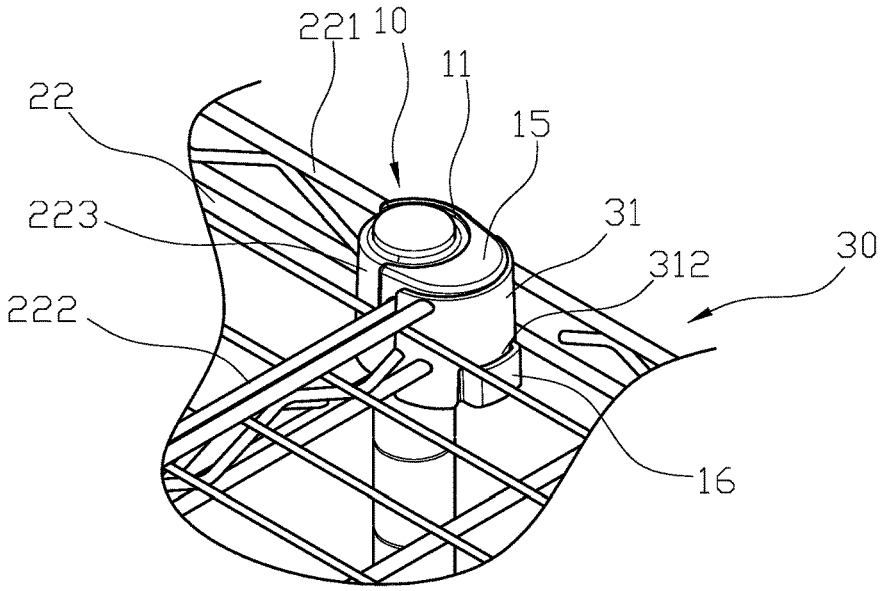
FIG. 6 is a schematic view illustrating an external board is assembled adjacent to the shelf through the connector of the present invention.
Figure 7:
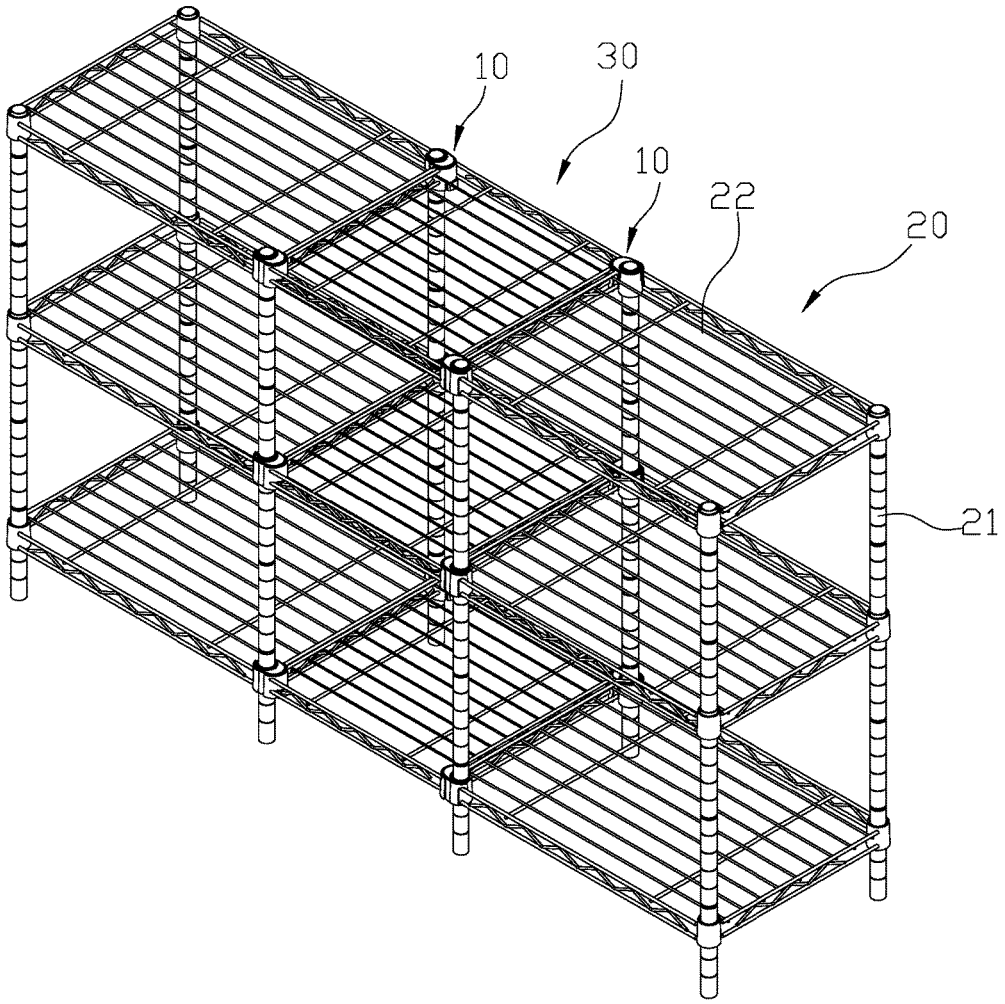
FIG. 7 is a three-dimensional assembly view illustrating that a plurality of the external boards are assembled between the two shelves through the connectors of the present invention.

Referring to FIGS. 4 and 5, the connector (10) is configured to couple with the collar (223) of the shelf board (22) through the concave (11) thereof, and the first hook portion (12) and the second hook portion (13) are provided to respectively hook on the first side bar (221) and the second side bar (222) at two sides of the collar (223). Also, the protruding portion (111) of the concave (11) is abutted against an upper edge of the collar (223), and the first connecting member (15) of the connector (10) is faced outwardly. Thus, two adjacent outer edges respectively on the two shelves (20) have two pairs of the connectors (10) face to face which are configured to cooperate with each other to assemble one external board (30) therebetween.

Referring to FIGS. 4 to 8, each of four corners of the external board (30) has a concaved second connecting member (31) which is faced outwardly and configured to engage with the first connecting member (15) of the connector (10). Moreover, a lower end of the second connecting member (31) comprises two vertical engaging notches (311) to form an engaging block (312) therebetween, wherein the engaging block (312) is adapted to engage with the engaging portion (16) of the first connecting member (15), thereby firmly assembling the external board (30) between the two shelves (20).

Comparing with conventional connector of shelf assembly, the present invention is advantageous because: (i) the connectors (10) can be directly assembled on the collars (223) of the shelf boards (22) on the two shelves (20) respectively, and the external board (30) can be directly assembled between the two shelves (30) without disassembling process; and (ii) the external board (30) can be assembled parallel with the shelf boards (22) on the two shelves (20), which improves the practicability and stability of the assembled shelves (20) with the external board (30) when in use.

Figure 8:
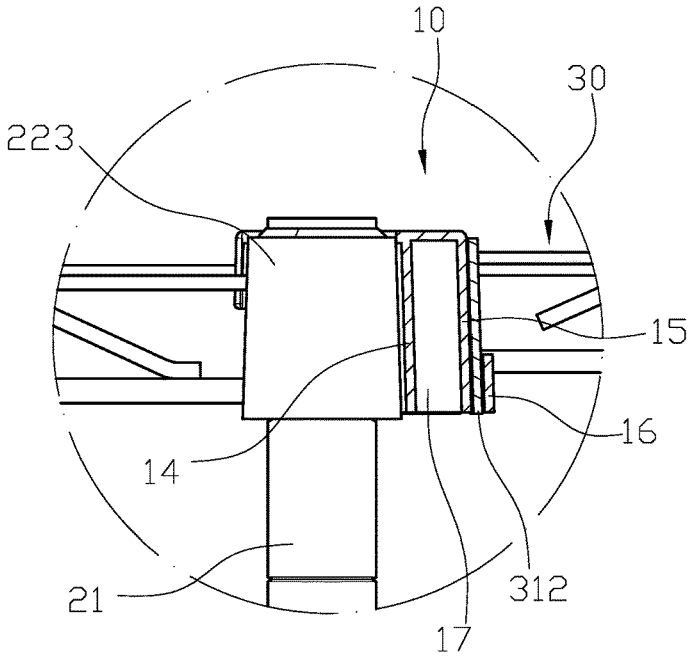
FIG. 8 is a sectional view illustrating the external board is assembled adjacent to the shelf through the connector of the present invention.
Figure 9:
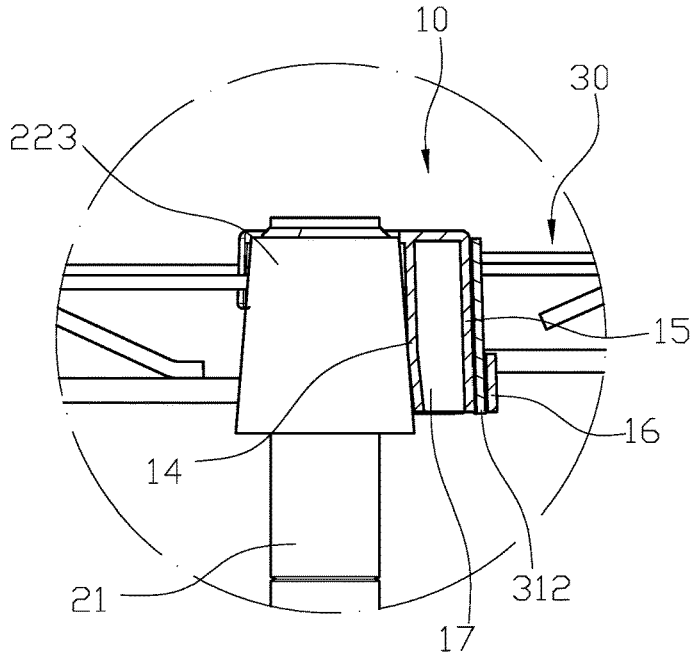
FIG. 9 is a sectional view illustrating the external board is assembled adjacent to the shelf, which has a different size of collar, through the connector of the present invention.
Figure 10:
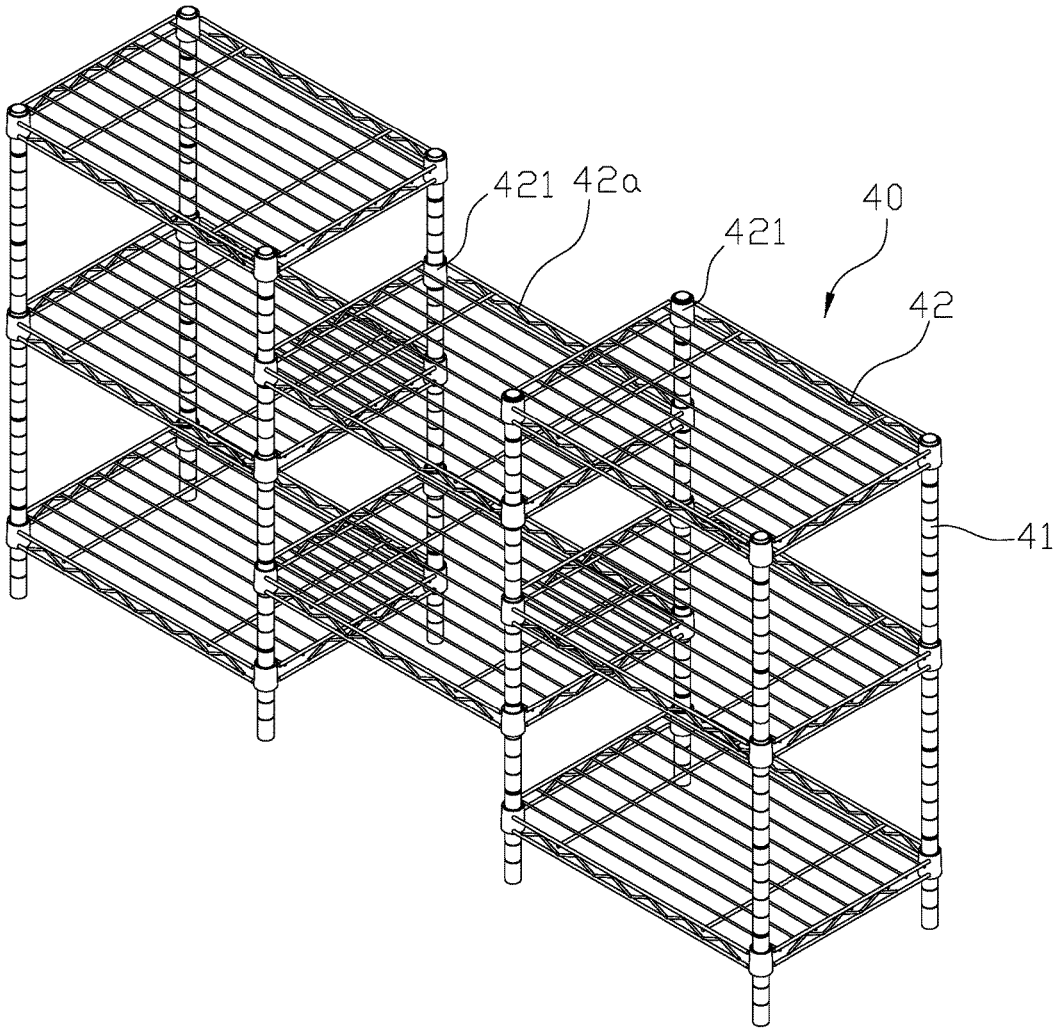
FIG. 10 PRIOR ART
FIG. 10 is a prior art.
Figure 11:
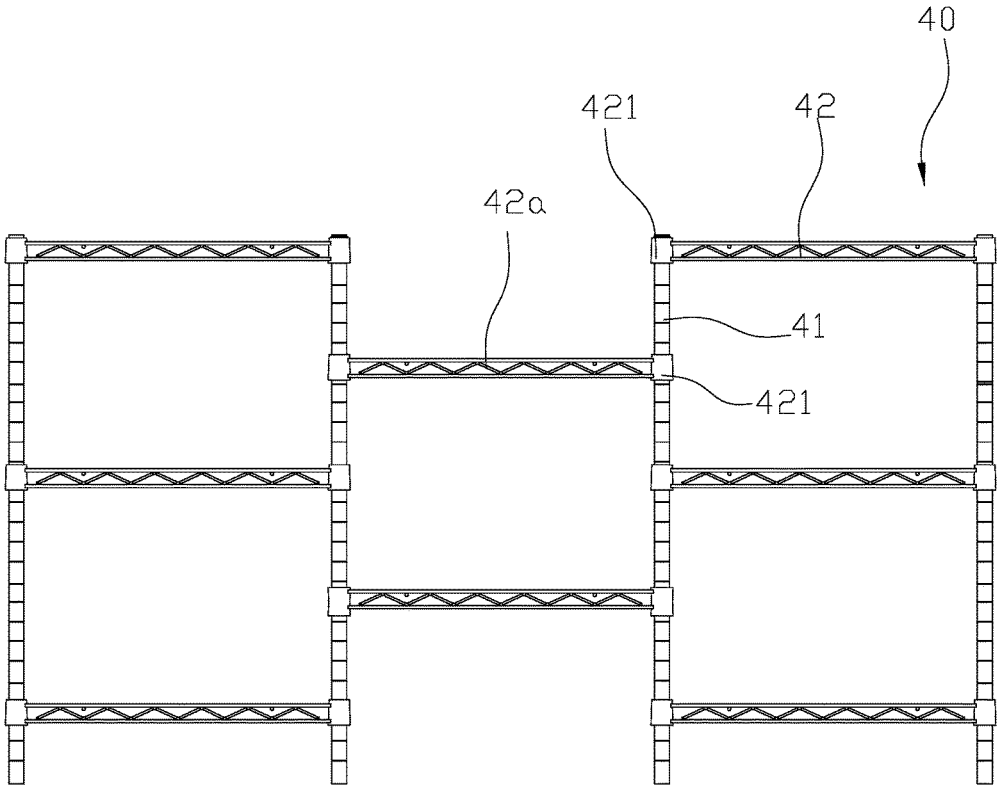
FIG. 11 PRIOR ART
FIG. 11 is a prior art.

Furthermore, referring to FIGS. 8 and 9, the connector (10) has a hollow cushion member (17) formed between the attaching surface (14) and the first connecting member (15), which can effectively prevent the connector (10) from getting stuck on the collar (223) of the shelf board (22) when disassembling process and also can enable the attaching surface (14) to be pressed inwardly thereby applied to a larger or longer collar (223).

Having described the invention by the description and illustrations above, it should be understood that these are exemplary of the invention and are not to be considered as limiting. Accordingly, the invention is not to be considered as limited by the foregoing description, but includes any equivalents.

What is claimed is:

1. A connector for shelf assembly comprising:

at least a connecting unit having a C-shaped eccentric concave formed at a lateral edge thereof, and an inner edge of the concave comprising a protruding portion; a first hook portion and a second hook portion respectively protruding and extending downwardly from two lateral ends of the inner edge of the concave, an inner surface of the concave formed into an attaching surface, and an arc-shaped first connecting member formed on an outer surface of the connecting unit; an engaging portion integrally formed at an outer surface of the first connecting member, and a hollow cushion member formed between the attaching surface and the first connecting member.

2. The connector for shelf assembly of claim 1, wherein an included angle between an axial central line of the concave to the first hook portion and the second hook portion is 90 degree such that when the connecting unit is applied to the shelf, the first hook portion and the second hook portion thereof are configured to respectively hook on two adjacent edges of a shelf board of the shelf which are perpendicular to each other.

* * * * *